US006695158B2

(12) United States Patent
Taylor et al.

(10) Patent No.: US 6,695,158 B2
(45) Date of Patent: Feb. 24, 2004

(54) CRANE WITH SELF-RAISING MAST

(75) Inventors: John Taylor, Manitowoc, WI (US); Arthur Zuehlke, Manitowoc, WI (US)

(73) Assignee: Manitowoc Crane Companies, Inc., Reno, NV (US)

( * ) Notice: Subject to any disclaimer, the term of this patent is extended or adjusted under 35 U.S.C. 154(b) by 0 days.

(21) Appl. No.: 10/068,563

(22) Filed: Feb. 4, 2002

(65) Prior Publication Data

US 2003/0146181 A1 Aug. 7, 2003

(51) Int. Cl.[7] ..... B66C 23/34
(52) U.S. Cl. ..... 212/298; 212/270; 212/299
(58) Field of Search ..... 212/298, 299, 212/270

(56) References Cited

U.S. PATENT DOCUMENTS 2,813,636 A * 11/1957 Preston
4,081,081 A * 3/1978 Morrow et al. ..... 212/298
4,579,234 A * 4/1986 Delago et al. ..... 212/178
5,240,129 A 8/1993 Schrick et al.

FOREIGN PATENT DOCUMENTS

JP 9-328295 * 12/1997

* cited by examiner

*Primary Examiner*—Thomas J. Brahan
(74) *Attorney, Agent, or Firm*—Brinks Hofer Gilson & Lione

(57) ABSTRACT

An apparatus and method of self-raising a mast for a crane having an upper works rotatably mounted on a lower works and a boom pivotally mounted on the upper works, the boom being supported by boom hoist rigging and a mast pivotally connected to the upper works. The crane further includes a self-raising mast assembly for controlling the position of the mast when the mast is not connected to the boom and is not supportable by the boom hoist rigging. The self-raising mast assembly comprises a mast raising yoke pivotally connected to the upper works, a hydraulic mast raise cylinder pivotally connected between the upper works and the mast raising yoke, and a hydraulic system for controlling the mast raise cylinder.

51 Claims, 9 Drawing Sheets

54
54
28
32
56
10
50
32
36
26
32
38
34
48
22
30
12
14
24
18
20
16

CRANE WITH SELF-RAISING MAST

BACKGROUND OF THE INVENTION

The present application relates to construction equipment, such as cranes. In particular, the present application relates to a crane having several unique and inventive aspects, such as a self-raising mast, a hydraulic circuit for raising the mast, and a microprocessor-based controller for controlling the mast raising procedure. The present application also relates to a method of self-raising the mast and assembling the crane.

Construction equipment, such as cranes or excavators, must often be moved from one job site to another. Moving a crane or an excavator can be a formidable task when the machine is large and heavy. For example, highway limits on vehicle-axle loads must be observed, and overhead obstacles can dictate long, inconvenient routings to the job site.

One solution to improving the mobility of large construction machines, such as cranes, is to disassemble them into smaller, more easily handled components. The separate components can then be transported to the new job site where they are reassembled.

The typical practice has been to use an assist crane to disassemble the crane into the separate components. The assist crane is then used to load the components onto their respective transport trailers. Once at the new job site, another assist crane is used to unload the components and reassemble the crane. As the components for a large crane can weigh as much as 80,000 lbs., the capacity of the assist crane required represents a very significant transport expense.

As a result, designers have attempted to develop self-handling systems for assembling and disassembling cranes. The majority of the self-handling systems developed thus far have been directed to smaller cranes that only need to be disassembled into a few components.

The development of self-handling systems for larger cranes, however, has met with limited success. One reason for this is that larger cranes need to be disassembled into numerous components, thus requiring time-consuming disassembly and reassembly procedures. For example, a large capacity crane typically uses a complicated and cumbersome rigging system to control the angle of the boom. Boom rigging system components such as the equalizer, the mast, and wire rope rigging are heavy and difficult to disassemble for transport. Another reason for the limited success of prior art self-assembling cranes is that they typically rely on additional crane components that are used only for assembling and disassembling the crane. For example, some self-assembling cranes require additional wire rope guides and sheaves on the boom butt so that a load hoist line can be used with the boom butt to lift various crane components during the assembly process.

An example of a prior art method for assembling and disassembling a typical large capacity crawler crane is disclosed in U.S. Pat. No. 5,484,069, titled "Process For Self-Disassembling A Crawler Crane" ("the '069 patent"). In particular, this patent is directed to a type of crawler crane having a mast that is supported by a backhitch.

Another example of a prior art method for assembling and disassembling a different type of crawler crane is disclosed in U.S. Pat. No. 6,062,405, titled "Hydraulic Boom Hoist Cylinder Crane" ("the '405 patent"). This patent is directed to a type of crane that utilizes hydraulic cylinders to control the angle of the boom.

The '069 patent and the '405 patent are both examples of self-assembling cranes that require the use of the boom butt to lift and position components for assembly on to the crane. As a consequence, additional sheaves must be included on the boom butt for the self-assembling procedure. It is therefore desirable to provide a crane and method of self-assembly which eliminates, or at least reduces, the use of the boom butt during the self-assembling procedure.

In addition to the above, some types of cranes utilize a moving or live mast. A crane having a moving or live mast is connected directly to the boom by one or more boom pendants. The boom angle is controlled by boom hoist rigging, which is connected between the mast and the upper works of the crane. The mast and the boom move together as the boom angle is changed. The mast must typically be disconnected from the boom and stored horizontally on top of the crane for transport between job sites. Moreover, the masts on these types of cranes are often very long and heavy, and are consequently difficult to handle during the assembly process. It is therefore desirable to provide a crane having a self-raising mast. It is also desirable to provide a system and method of controlling the mast self-raising procedure that is safe, efficient and easy to implement.

BRIEF SUMMARY OF THE INVENTION

In preferred aspects, the present invention comprises a crane having an upper works rotatably mounted on a lower works, a boom pivotally mounted on the upper works, a mast pivotally mounted on the upper works and pendantly connected to the boom, and boom hoist rigging connected to the mast for controlling the angle of the boom. The invention further comprises a self-raising mast assembly for controlling the position of the mast when the mast is not connected to the boom. The self-raising mast assembly comprises a mast raising yoke, a hydraulic mast raise cylinder, and a hydraulic system.

The mast raising yoke is pivotally connected to the upper works and preferably has an axis of rotation that is aligned with the axis of rotation of the mast. The mast raising yoke is configured to engage and support the mast when the mast is not within the mast operating range, and is disengaged from the mast when the mast is within the mast operating range, the mast being supportable by the boom hoist rigging when the mast is within the mast operating range.

The hydraulic mast raise cylinder is pivotally connected between the upper works and the mast raising yoke. The hydraulic mast raise cylinder is extendable and retractable so as to rotate the mast raising yoke. The hydraulic system controls the extension and retraction of the hydraulic mast raise cylinder.

The preferred method of self-raising the mast comprises the steps of first engaging the mast with the mast raising yoke when the mast is in a rearwardly extending stored position on a rearward portion of the upper works, then extending the mast raise cylinder to rotate the mast raising yoke in a first direction so as to pivot the mast upwardly from the stored position to a forwardly leaning position. When the mast is in the forwardly leaning position, the mast is then supported with the boom hoist rigging, while the mast raise cylinder is retracted to rotate the mast raising yoke in a second direction so as to disengage said mast raising yoke from the mast. The boom hoist rigging is then extended to lower the mast towards a forwardly extending fully forward position in front of the upper works, where it is then engaged by the mast raising yoke. The mast raise cylinder is then extended to rotate the mast raising yoke in the first direction so as to pivot the mast downwardly to the fully forward position. The mast can then be connected to the boom.

The self-raising mast assembly and method permits the mast to be raised and lowered during the assembly process without the need for a separate crane, and overcomes many of the problems identified above. In particular, the self-raising mast assembly and method permits the mast to be raised from and lowered to a stored position on the rearward portion of the upper works. The assembly and method also permits the mast to be raised from and lowered to a fully forward position in front of the upper works. Moreover, the assembly and method permits the mast to be used for lifting and assembling crane components during the crane self-assembly and self-disassembly process.

These and other advantages, as well as the invention itself, will become apparent in the details of construction and operation as more fully described and claimed below. Moreover, it should be appreciated that several aspects of the invention can be used with other types of cranes, machines or equipment.

DETAILED DESCRIPTION OF THE INVENTION

Figure 1:
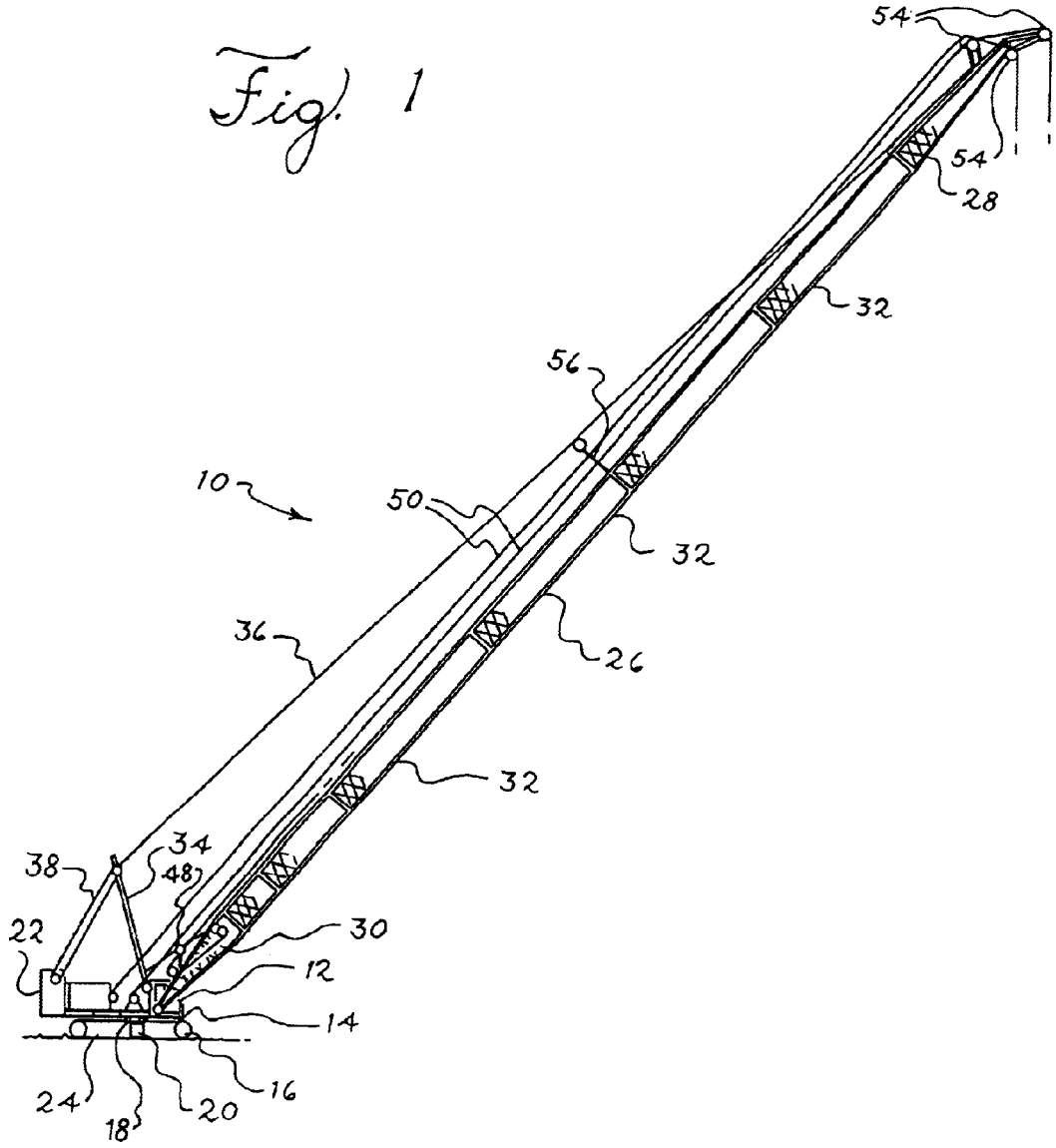
FIG. 1 is a right side elevational view of a complete crane incorporating a self-raising mast made in accordance with the teachings of this invention.

While the present invention will find application in all types of cranes or construction machines, the preferred embodiment of the invention is described in conjunction with the crawler crane 10 of FIG. 1. The crawler crane 10 includes an upper works 12 having a rotating bed 14 that is rotatably connected to a lower works 16 by a swing bearing 18. The lower works 16 includes a car body 20, counterweights 22, and two independently powered crawlers 24.

The upper works 12 includes a boom 26 pivotally connected to the upper works 12. The boom 26 comprises a boom top 28 and a tapered boom butt 30. The boom 26 may also include one or more boom inserts 32 connected between the boom top 28 and the boom butt 30 to increase the overall length of the boom 26. A mast 34 is pivotally connected to the upper works 12. The boom 26 is connected to the mast 34 by one or more boom pendants 36.

Figure 17:
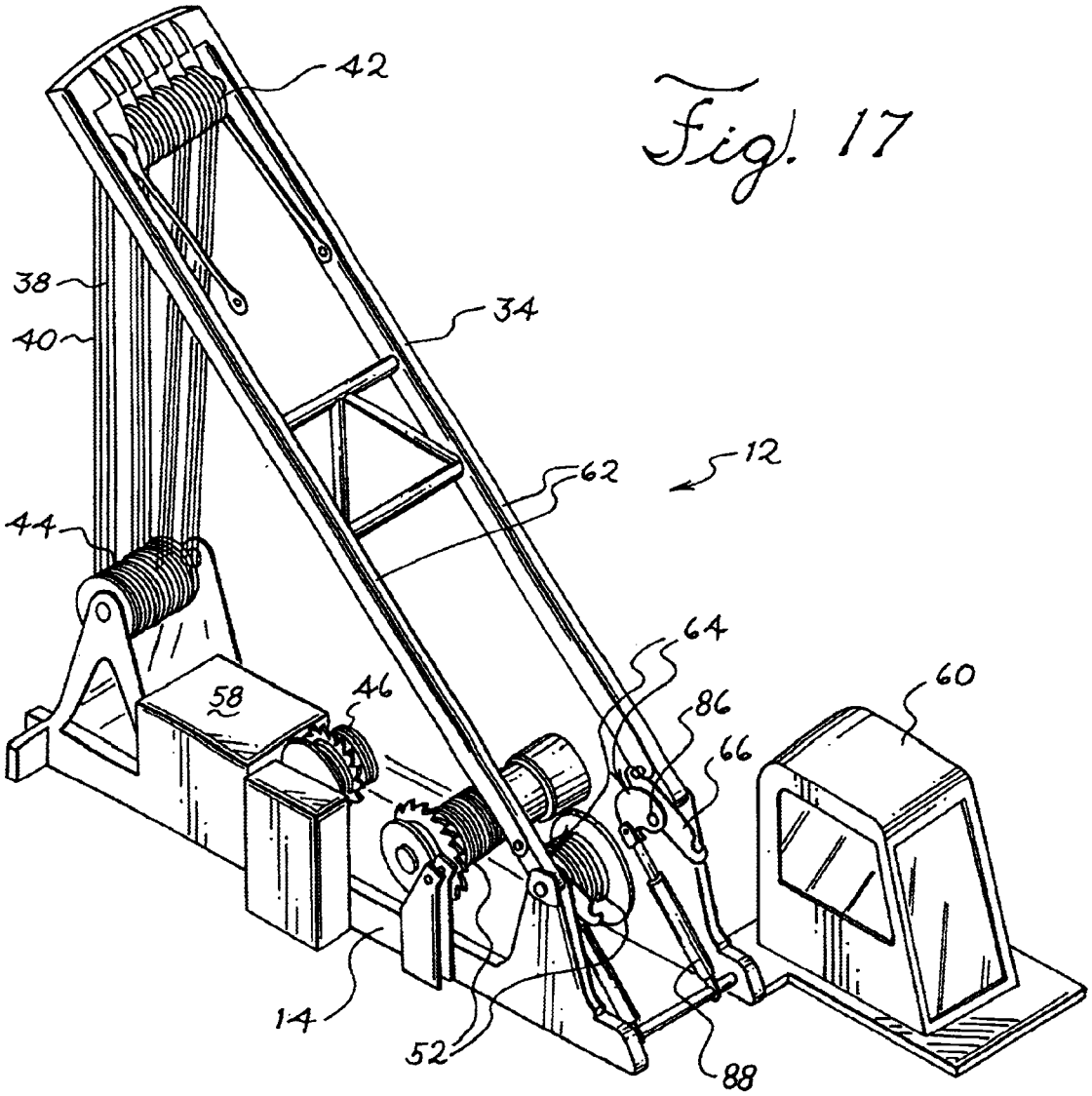
FIG. 17 is an isometric view of the crane upper works showing the mast being raised during the self-raising mast procedure.

The angle of the boom 26 is controlled by boom hoist rigging 38 connected between the upper works 12 and the mast 34. As best seen in FIG. 17, the boom hoist rigging 38 comprises a boom hoist rope 40 that passes (reeved) around a sheave assembly 42 on the upper end of the mast 34 and a sheave assembly 44 on the rear end of the upper works 12. One end of the boom hoist rope 40 is typically anchored to the upper works 12, while the other end is anchored to and wrapped around the boom hoist drum 46.

The mast 34 supports the connection between the boom hoist rigging 38 and the boom pendants 36 at a location that is distanced from the axis of the boom 26 to optimize the forces in the boom pendants 36 and the boom hoist rigging 38. This arrangement also permits the boom hoist rigging 38 to impart a force having a component that is perpendicular to the axis of the boom 26. This force is transferred to the end of the boom 26 by the boom pendants 36. Because the weight of the boom 26 is significantly greater than the weight of the mast 34 and the boom hoist rigging 38, the boom hoist rope 40 and the boom pendants 36 are always in tension as long as the boom 26 is within the normal operating range of the crane 10. Conversely, the mast 34 is always in compression as long as the boom 26 is within the normal operating range of the crane 10. A boom backstop 48 is provided to prevent the boom 26 from exceeding a safe operating angle (see FIG. 1).

Rotation of the boom hoist drum 46 in one direction (e.g., clockwise) will retract the boom hoist rope 40, thereby shortening the length of the boom hoist rigging 38 and causing the upper end of the mast 34 to be pulled towards the rear of the upper works 12. This in turn raises the end of the boom 26 (i.e., increases the boom angle). Likewise, rotation of the boom hoist drum 46 in the opposite direction (e.g., counter-clockwise) will pay out the boom hoist rope 40, thereby increasing the length of the boom hoist rigging 38 and allowing the upper end of the mast 34 to be pulled away from rear of the upper works 12 by the weight of the boom 26. This action results in the lowering of the end of the boom 26 (i.e., decreases the boom angle).

The upper works 12 further includes one or more load hoist lines 50 for lifting loads. Each load hoist line 50 is passed (reeved) around a load hoist line drum 52 supported on the rotating bed 14 of the upper works 12. The load hoist line drums 52 are rotated to either pay out or retrieve the load hoist lines 50. The load hoist lines 50 are reeved around a plurality of boom top sheaves 54 located at the upper end of the boom top 28. The boom may also include one or more wire rope guides 56 attached to upper surface of the boom 26 to prevent the load hoist lines 50 from interfering with the lattice structure of the boom 26. A hook block (not shown) is typically attached to each load hoist line 50.

As best seen in FIG. 17, the upper works 12 further includes a power plant 58, such as a diesel engine, and a counterweight assembly 22 (see FIG. 1). The power plant 58 supplies power for the various mechanical and hydraulic operations of the crane 10, including movement of the crawlers 24, rotation of the rotating bed 14, rotation of the load hoist line drums 52, and rotation of the boom hoist drum 46. Operation of the various functions of the crane 10 is controlled from the operator's cab 60.

Figure 2:
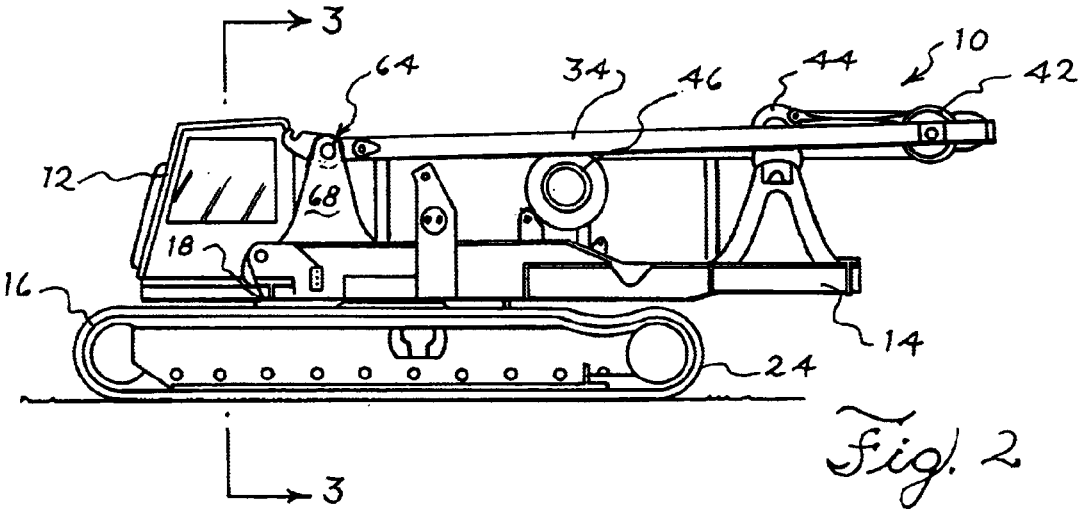
FIG. 2 is a left side elevational view of the partially assembled crane with the mast in the stored position.
Figure 3:
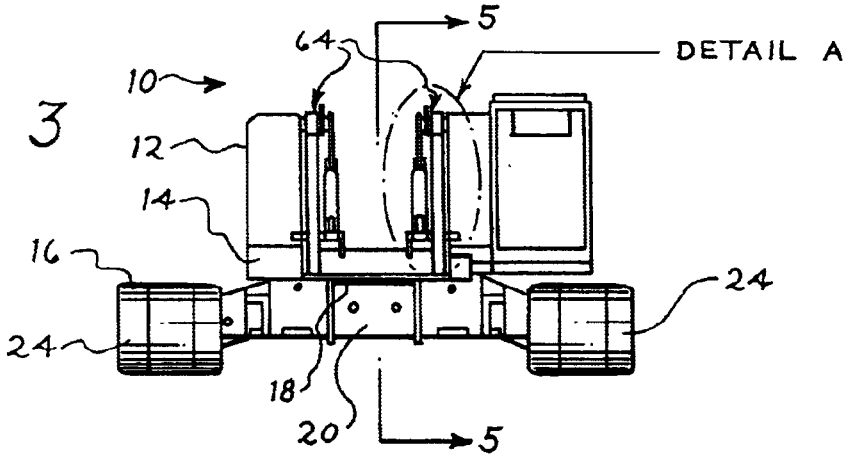
FIG. 3 is a partial sectional view of the crane taken along line 3—3 of FIG. 2 showing the location of the self-raising mast assemblies.

In the preferred embodiment shown, the mast 34 is comprised of a steel frame having spaced apart rectangular legs 62. The mast 34 should not interfere with the operation of the load hoist lines 50 or the boom backstop 48. In addition, the mast 34 should be configured so as to permit the mast 34 to be lowered to an approximately horizontal stored position on top of the upper works 12 when the crane 10 has been disassembled for transport, as shown in FIG. 2. This permits the overall height of the disassembled crane 10 to be minimized so that highway height restrictions will not be violated during transport to and from the job site. As will be explained below, the mast 34 is ordinarily not disassembled from the crane 10 during transport. The mast 34 should also be configured so as to permit the mast 34 to be lowered to an approximately horizontal fully forward position in front of the upper works 12. As will be explained below, it is desirable to lower the mast 34 to the fully forward position to permit access to the upper end of the mast 34 from the ground.

The crane 10 of the preferred embodiment also comprises a pair of self-raising mast assemblies 64 for raising and lower the mast 34 during the assembling and disassembling of the crane 10. As best seen in FIGS. 2–6, the self-raising mast assemblies 64 each comprise a mast raising yoke 66 pivotally supported by a mast support frame 68 on either side of the upper works 12. The lower end of each leg 62 of the mast 34 is likewise supported by the mast support frame 68. These components are preferably arranged so that the mast 34 and the mast raising yoke 66 have the same axis of rotation 70 about the upper works 12. However, it should be noted that it is not necessary for the axis of rotation of the mast raising yoke 66 to be coincident with the axis of rotation of the mast 34. As best seen in FIG. 17, each mast support frame 68 of the preferred embodiment comprises a pair of vertical walls 72 that are disposed on each side of the leg 62 of the mast 34. The mast raising yokes 66 are disposed along the inside of the mast support frame 68 (i.e., to the inside of the legs 62 of the mast 34) (see FIG. 3). Each leg 62 of the mast 34 is supported by a support pin 74 that extends through the vertical walls 72 of each mast support frame 68. The mast raising yoke 66 is likewise supported by the support pin 74.

Figure 6:
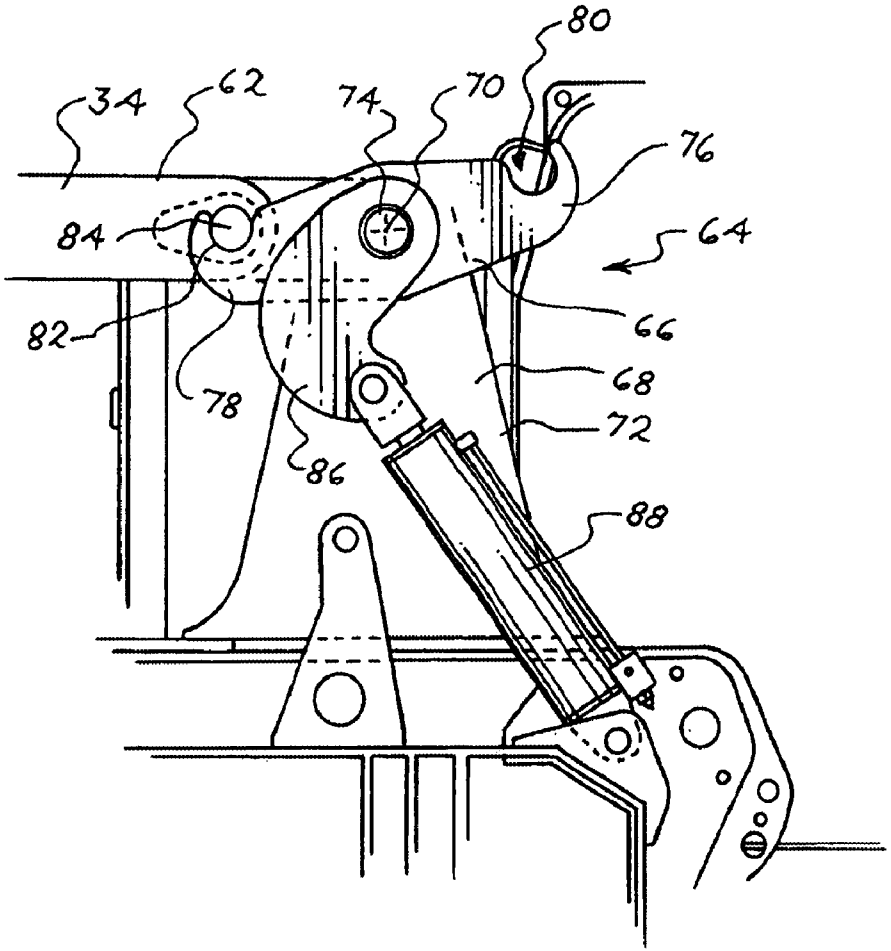
FIG. 6 is an enlarged view of detail B of FIG. 5 showing the principal components of a self-raising mast assembly.
Figure 4:
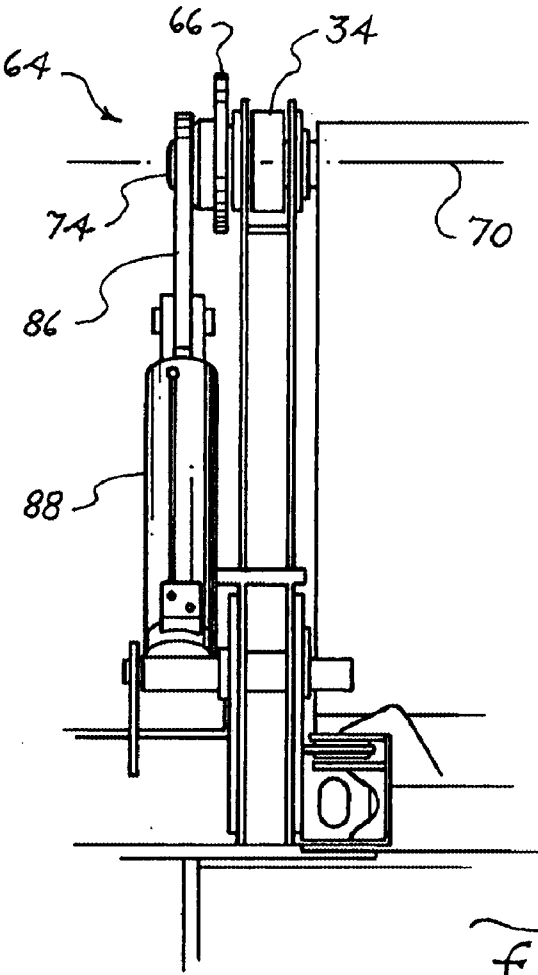
FIG. 4 is an enlarged view of detail A of FIG. 3 showing the principal components of a self-raising mast assembly.

As best seen in FIG. 6, each mast raising yoke 66 comprises a forward arm 76 and a rearward arm 78. The forward arm 76 and the rearward arm 78 each comprise an engagement slot 80, 82 on the upper surfaces thereof. As will be explained in greater detail below, the engagement slots 82, 84 are configured so as to engage a lifting pin 84 on the inside surface of each leg 62 of the mast 34. In the preferred embodiment, the engagement slot 80 on the forward arm 76 and the engagement slot 82 on the rearward arm 76 are separated by an angle of 160° about the axis of rotation 70, said angle being measured along an arc above the support pin 74. In other words, if the mast raising yoke 66 is oriented so that the rearward arm 76 is disposed horizontally (i.e., parallel to the ground) and towards the rear of the crane 10 (i.e., rearwardly from the axis of rotation 70), then the forward arm 76 will be disposed towards the front of the crane 10 (i.e., forwardly from the axis of rotation 70) and at an angle of 20° above horizontal.

Each self-raising mast assembly 64 further comprises a lever arm 86 that is pivotally connected to the support pin 74 so as to be pivotal about the axis of rotation 70. The lever arm 86 is welded or otherwise fastened to the mast raising yoke 66 so that the lever arm 86 and the mast raising yoke 66 rotate about the axis of rotation 70 as a unitary component. In other words, the lever arm 86 and the mast raising yoke 66 rotate together. In the preferred embodiment shown, the lever arm 86 is a sub-component of the mast raising yoke 66.

Each self-raising mast assembly 64 further comprises a hydraulic mast raise cylinder 88 that is connected to an end of the lever arm 86. In particular, the upper end of the mast raise cylinder 88 (i.e., the piston rod) is connected to an end of the lever arm 86, and the lower end of the mast raise cylinder 88 (i.e., the bore) is connected to the upper works 12. As best seen in FIG. 6, the mast raise cylinder 88 is arranged so that extension or contraction thereof will cause the lever arm 86, and in turn the mast raising yoke 66, to rotate (i.e., pivot) about the axis of rotation 70. As will be discussed in greater detail below, the mast raise cylinder 88 and the lever arm 86 are preferably configured so that extension or contraction of the mast raise cylinder 88 will rotate the mast raising yoke 66 through an angle of approximately 115°. For example, when the mast raise cylinder 88 is fully contracted, the rearward arm 76 will be disposed horizontally (i.e., parallel to the ground) and towards the rear of the crane 10. When the mast raise cylinder 88 is fully extended, then the rearward arm 76 will be disposed towards the front of the crane 10 at an angle of 65° above horizontal. The extension and retraction of the mast raise cylinders 88 is controlled by a hydraulic circuit (to be described below).

The preferred method of self-assembling the crawler crane 10 is best seen by referring to FIGS. 7–16 and the description above.

Figure 7:
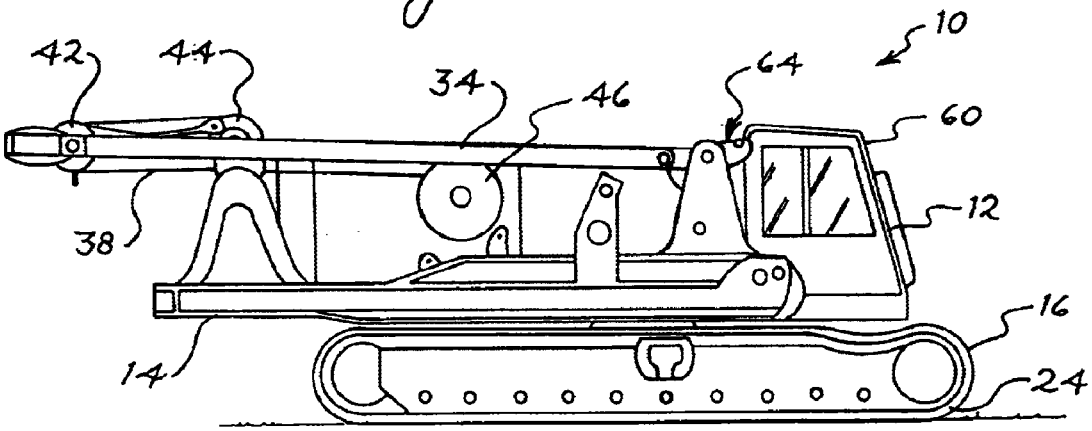
FIGS. 7–10 are right side elevational views of the crane in sequential stages of the self-raising mast procedure.

Referring to FIG. 7, the disassembled crawler crane 10 is delivered to the job site on a transport trailer (not shown). Additional components, such as the boom top 28, boom inserts 32, and the counterweights 22 are delivered on separate transport trailers (not shown) prior to their assembly to the crane 10. Although in the preferred embodiment shown, the crawlers 24 remain assembled to the crane 10 during transport between job sites, these components may be delivered separately and assembled to the crane 10 during the self-assembly process. A method and apparatus for assembling the crawlers 24 to the car body 20 are disclosed in U.S. Pat. No. 5,427,256, titled "Crane Upper Works To Lower Works Alignment System". Another method of assembling the crawlers 24 to the car body 20 is disclosed in U.S. Pat. No. 5,823,279, titled "Carbody To Crawler Connection".

Figure 5:
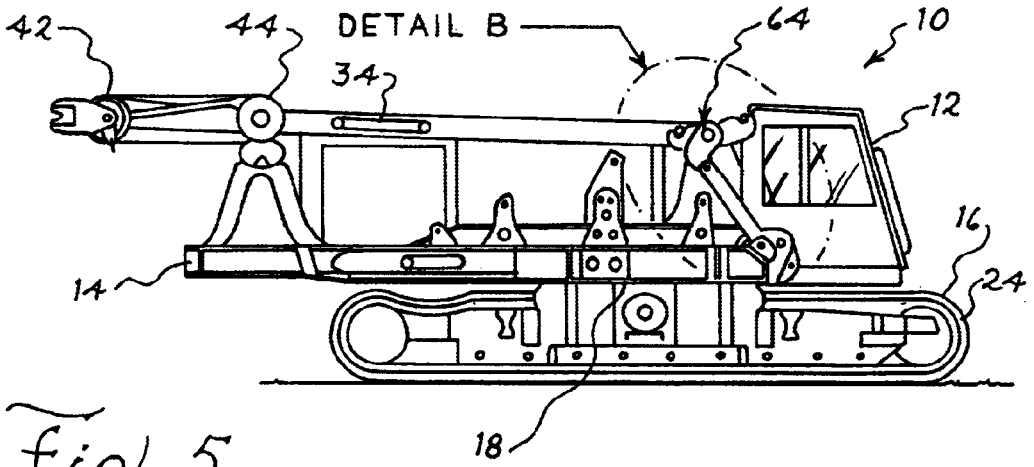
FIG. 5 is a partial sectional view of the crane taken along line 5—5 of FIG. 3 showing the location of the self-raising mast assemblies.

As best seen in FIGS. 5 and 7, the mast 34 remains connected to the upper works 12 during transport of the partially disassemble crane 10 from one job site to another. As explained above, because the mast 34 is a large and heavy component, it is advantages to keep the mast 34 assembled to the crane 10. This also avoids the need to disassemble the boom hoist rigging 38 from between the mast 34 and the upper works 12. Nevertheless, it is necessary to position the mast 34 in a collapsed, horizontal position on top of the upper works 12 for transport. Orienting the mast 34 in this position allows the overall height and length of the partially disassembled crane 10 to be reduced so as to avoid most overhead obstacles and reduce the length of the transport vehicle required. Moreover, storing the mast 34 onto the rearward portion of the upper works 12 allows the weight of the mast to be more evenly distributed between the front and rear axles of the transport vehicle (not shown). This is an important consideration when highway limits on vehicle-axle loads must be observed.

The preferred method of self-raising the mast 34 is best seen by referring to FIGS. 6–16 and the description above of the self-raising mast assemblies 64. As best seen in FIGS. 6 and 7, when the mast 34 is stored on the rearward portion of the upper works 12, the lifting pin 84 on the inside of each leg 62 of the mast 34 is disposed within the rear engagement slot 82 on the rearward arm 76 of the mast raising yoke 66. Preferably, the lifting pin 84 is not resting directly on the bottom surface of the rear engagement slot 82. This prevents the mast 34, which may be subjected to movement or vibration during transport, from impacting the mast raising yoke 66.

Figure 11:
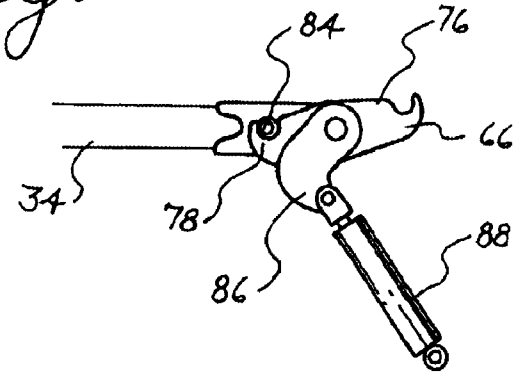

As best seen in FIG. 6, the rearward arm 76 of the mast raising yoke 66 is oriented approximately horizontal. This is referred to as the stored position for the mast raising yoke 66. More specifically, the center of the rear engagement slot 82 on the rearward arm 76 is at approximately the same elevation (or slightly below) as the axis of rotation 70 of the mast 34. For the purpose of this description of the mast self-raising procedure, the orientation of mast raising yoke 66 and the mast 34 will be described in angles measured from a horizontal line extending rearwardly from the axis of rotation 70. The mast raising yoke 66, when in the stored position, is therefore defined as being oriented at 0°. The mast 34, when in the stored position, is likewise defined as being oriented at 0°. When the mast raising yoke 66 is in the stored position (i.e., at 0°), the mast raise cylinder 88 is fully retracted. The relative positions of the mast 34, the mast raising yoke 66, and the mast raise cylinder 88, when in the stored position, are also shown in the schematic of FIG. 11.

Of course, it should be noted that if the axis of rotation of the mast raising yoke 66 is not coincident with the axis of rotation of the mast 34, then the relative angles of these components might differ. For example, if the axis of the mast raising yoke 66 is below the axis of rotation of the mast 34, then the rearward arm 76 might be oriented at an angle that is above horizontal when the mast 34 is horizontal.

Figure 8:
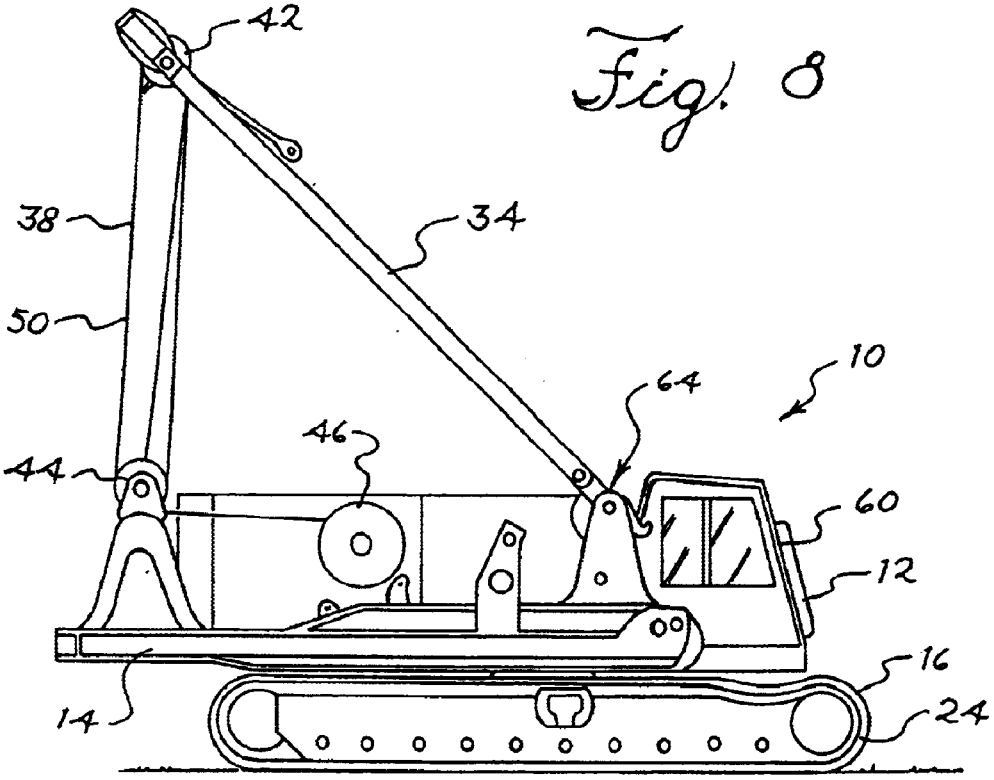

To initiate the mast self-raising procedure, the mast raise cylinder 88 is extended so as to apply a force to the end of the lever arm 86, thereby causing the mast raising yoke 66 to rotate in a clockwise direction (as viewed in FIG. 6). As the rearward arm 76 of the mast raising yoke 66 swings upward, the rear engagement slot 82 engages the lifting pin 84 on the mast 34. As best seen in FIG. 8, the mast raise cylinder 88 is extended further to continue rotation of the mast raising yoke 66 so as to pivot the mast 34 up from the stored position and off of the upper works 12. As the mast 34 is pivoted upwards, the boom hoist rigging 38 must simultaneously be lengthened to allow the upper end of the mast 34 to freely move away from the rear end of the upper works 12. As explained above, the boom hoist rigging 38 is lengthened by rotating the boom hoist drum 46 so as to pay out the boom hoist rope 40. As will be explained in greater detail below, a slight tension is maintained in the boom hoist rigging 38 so as to maintain control of the mast 34. Tension is also maintained in the boom hoist rigging 38 so as to, for example, maintain proper spooling of the boom hoist rope 40 on the boom hoist drum 46. It should be noted that FIG. 8 shows the mast 34 and the mast raising yoke 66 both at an angle of approximately 45°.

Figure 9:
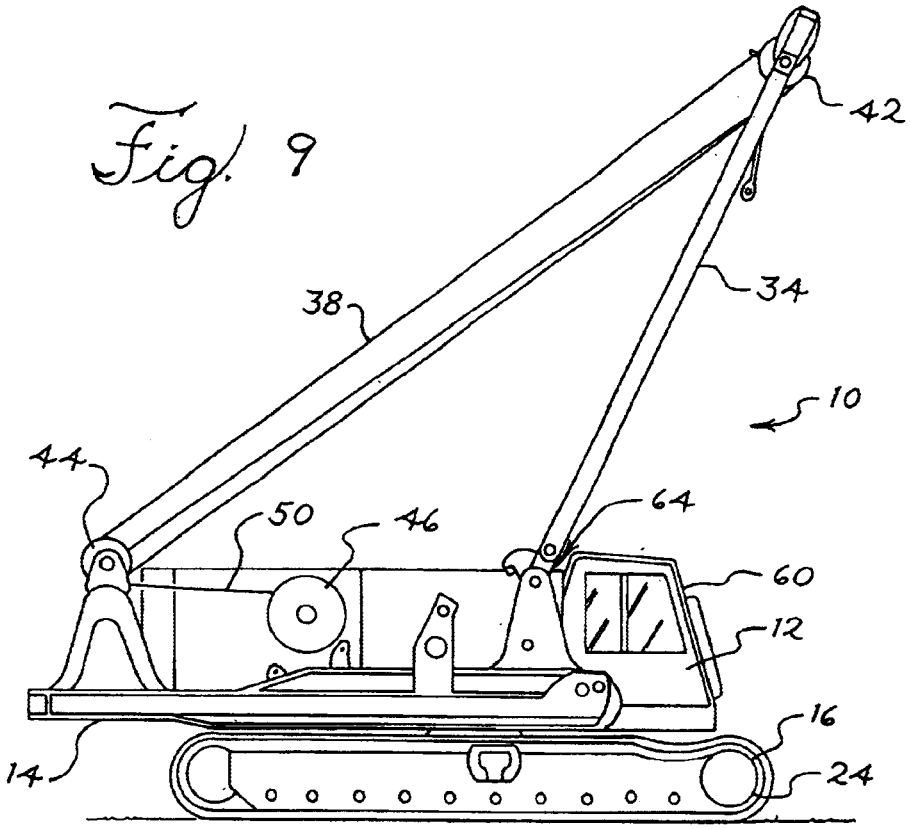
Figure 12:
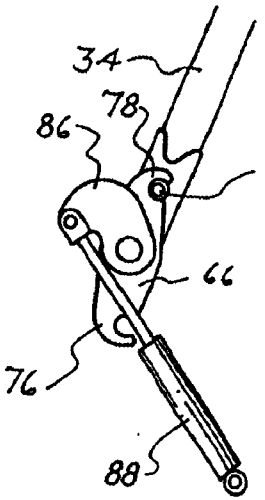
FIGS. 11–14 are schematic views of the self-raising mast assembly in sequential stages of the self-raising mast procedure.
Figure 14:
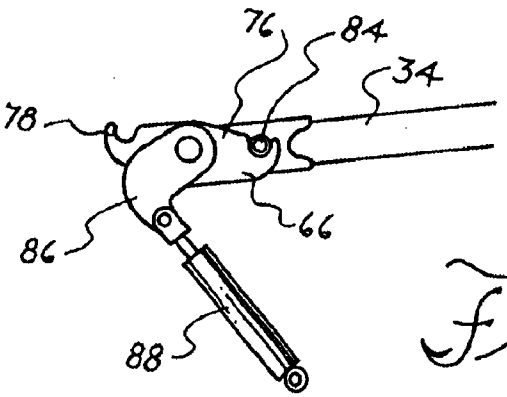

As shown in FIG. 9, extension of the mast raise cylinder 88 is continued until the mast 34 is pivoted past vertical and reaches a mast angle of approximately 115°. At a mast angle of 115°, the weight and the location of the center of gravity of the mast 34 are sufficient to maintain the mast 34 in a forward leaning orientation. In other words, the boom hoist rigging 38 can safely support the mast 34 once the mast 34 has reached a mast angle of 115°. Although this angle is considered to be the upper end of the safe operating range for the mast 34 while using only the boom hoist rigging 38, it should be appreciated that the mast 34 may be used above this range by utilizing the boom hoist rigging 38 in conjunction with the mast raising yoke 66. In other words, and as will be explained below, the mast 34 can be operated at angles between 90° and 115° by using the boom hoist rigging 38 together with the mast raising yoke 66. The relative positions of the mast 34, the mast raising yoke 66, and the mast raise cylinder 88, in this position, are also shown in the schematic of FIG. 12.

Of course, it should be noted that as the mast 34 approaches vertical, it can become unstable, and may move unpredictably in response to wind loads or vibrations from crane machinery. Thus, it is very important that tension be maintained in the boom hoist rigging 38 as the mast 34 approaches vertical. In other words, as the mast raising yoke 66 is applying a force to the mast 34 in one direction (i.e., pushing the mast 34 towards the front of the crane 10), the boom hoist rigging 38 must simultaneously apply a force to the mast 34 in the opposite direction (i.e., pulling the mast 34 towards the rear of the crane 10). These two opposing forces stabilize the mast 34.

Likewise, when the mast 34 moves (i.e., pivoted) past vertical, forward pressure is maintained on the mast 34 by the mast raising yoke 66. This forward pressure keeps the mast 34 from being tipped backwards by the weight of the boom hoist rigging 38 or any wind loads that may act on the mast 34. As explained above, once the mast has reached a mast angle of 115°, the weight and the location of the center of gravity of the mast 34 are sufficient to maintain the mast 34 in a forward leaning orientation, and it is no longer necessary for the mast raising yoke 66 to apply pressure to the mast 34.

Beyond a mast angle of 115°, the mast 34 is lowered towards the front of the crane 10 by continuing to extend the boom hoist rigging 38. At this time, the mast raise cylinder 88 is retracted so as to rotate the mast raising yoke 66 back to the stored position (i.e., 0°). As the mast raising yoke 66 is rotated back to the stored position (in a counter-clockwise direction as viewed in FIG. 9), the rear engagement slot 82 disengages and moves away from the lifting pin 84 on the leg 62 of the mast 34. In other words, the mast 34 is no longer supported by the mast raising yoke 66 once the mast 34 moves beyond 115°.

Figure 10:
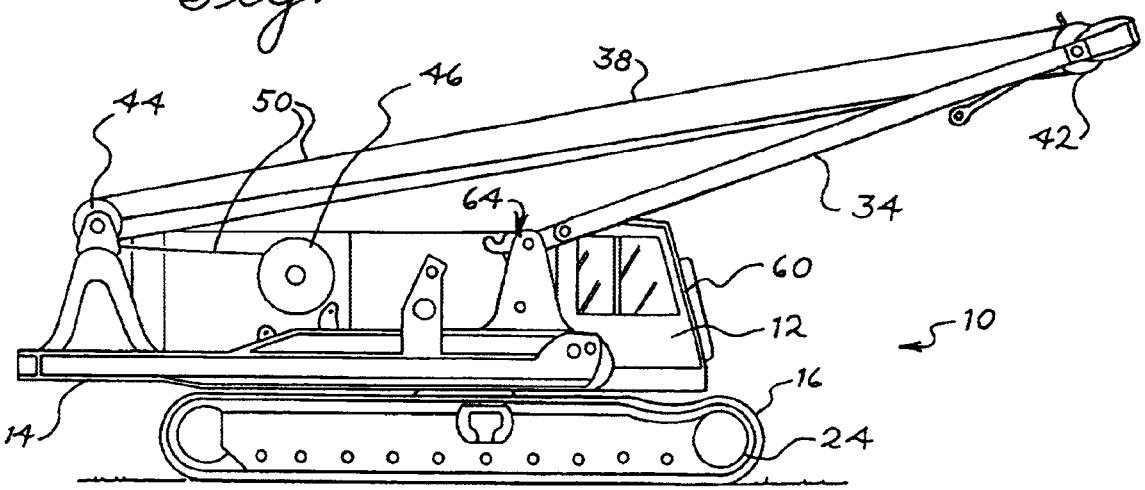

As shown in FIG. 10, the mast 34 is further lowered by extending the boom hoist rigging 38 until the mast 34 reaches a mast angle of approximately 160° (i.e., 20° above horizontal as measured from the front of the crane 10). Beyond this angle, boom hoist rigging 38 can no longer safely support the mast 34. This is because the direction of the force being applied to the mast 34 by the boom hoist rigging 38 is nearly parallel with the mast 34, and therefore does not apply a sufficient force perpendicular to the mast 34 to keep the mast 34 from continued rotation about the axis of rotation 70. Moreover, the forces applied to the mast 34 by the boom hoist rigging 38 at these angles may cause the mast 34 to buckle.

Although 160° is considered to be the lower end of the safe operating range for the mast 34 while using only the boom hoist rigging 38, it should be appreciated that the mast 34 may be used below this range by utilizing the mast raising yoke 66, either alone or in conjunction with the boom hoist rigging 38. In other words, the mast 34 can be operated at angles between 160° and 180° by using the mast raising yoke 66.

Figure 13:
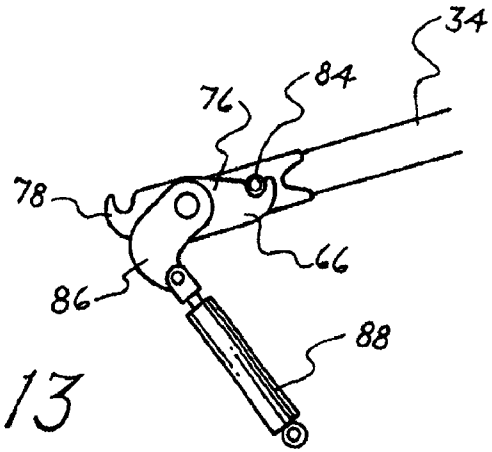
Figure 15:
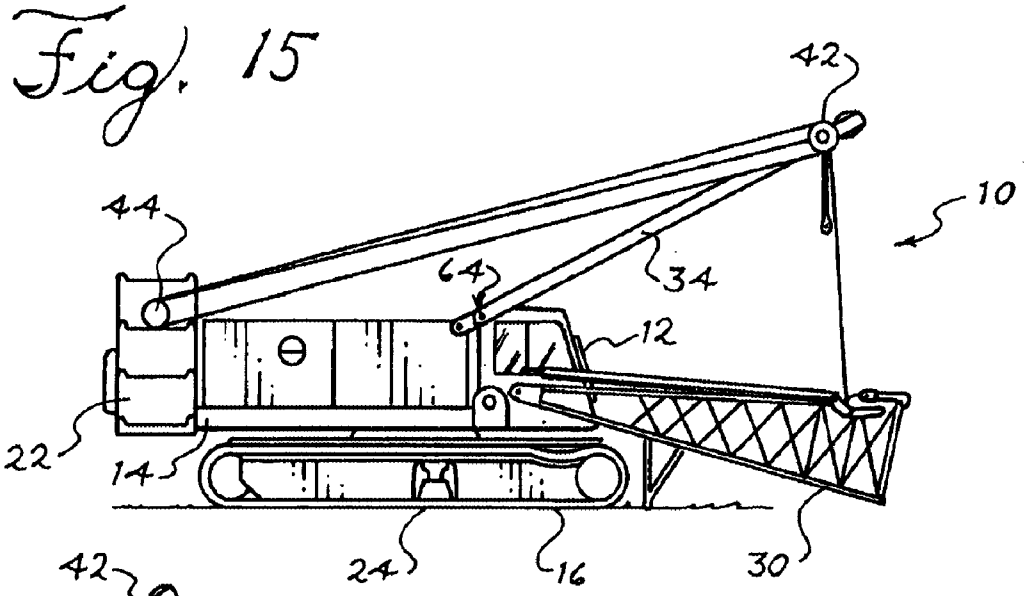
FIGS. 15–16 are right side elevational views of the crane in sequential stages of the boom assembly.
Figure 16:
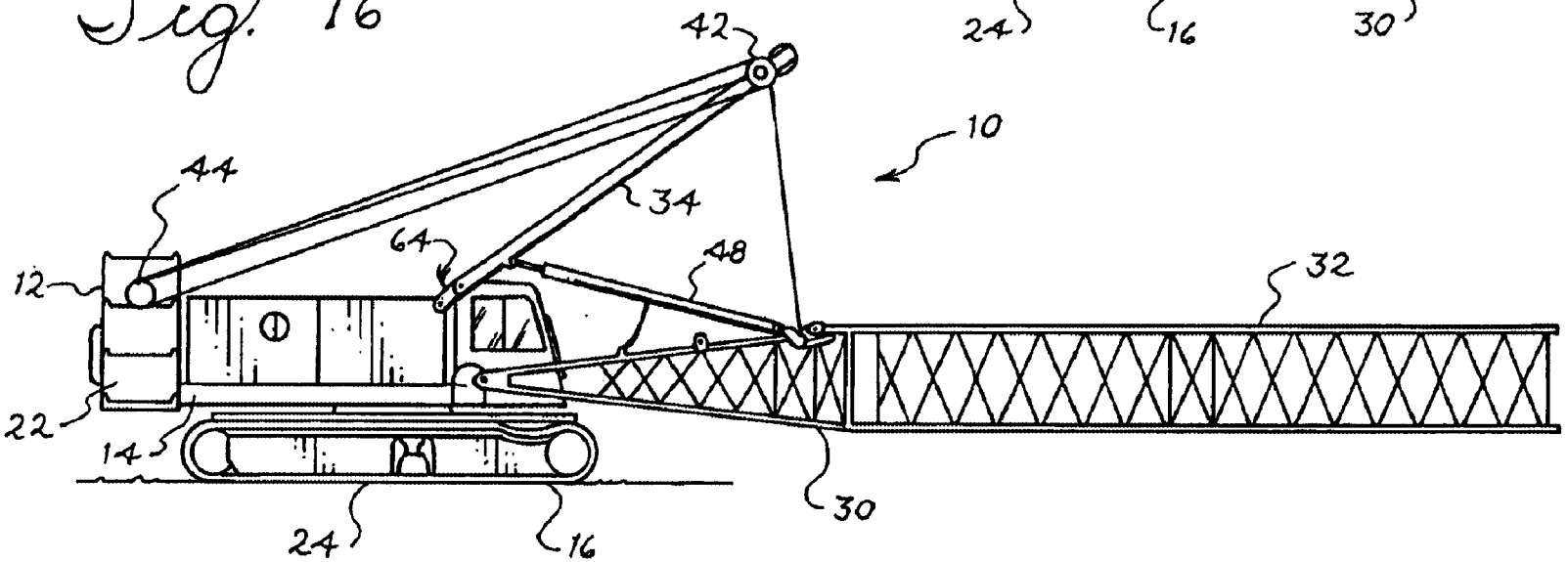

As the mast approaches a mast angle of 160°, the mast raise cylinder 88 is retracted so as to rotate the mast raising yoke 66 to the stored position (i.e., 0°). As explained above, when the mast raising yoke 66 of the preferred embodiment is in the stored position (see FIG. 6), the forward arm 76 of the mast raising yoke 66 is disposed approximately 20° above horizontal. In this position, the front engagement slot 80 on the forward arm 76 engages the lifting pin 84 on the leg 62 of the mast 34 when the mast 34 is at a mast angle of 160° (i.e., is 20° above horizontal). In other words, the mast raising yoke 66 is positioned so as to support the mast 34 when the mast 34 reaches the lower end of the range wherein it can be supported by the boom hoist rigging 38 alone. The relative positions of the mast 34, the mast raising yoke 66, and the mast raise cylinder 88, in this position, are also shown in the schematic of FIG. 13. Of course, these angles may be different if the center of rotation of the mast raising yoke 66 is not coincident with the center of rotation of the mast 34.

To lower the mast 34 further (i.e., beyond a mast angle of 160°), the mast raise cylinder 88 is extended to rotate the mast raising yoke 66 (in a clockwise direction as viewed in FIG. 10) and thereby lower the forward arm 76. Because the boom hoist rigging 38 is nearly parallel with the mast 34, the weight of the mast 34 is fully supported by the mast raising yoke 66. However, the boom hoist rigging 38 must still be extended to permit the mast 34 to be lowered by the mast raising yoke 66.

In the preferred method of self-assembling the crane 10, the mast 34 is lowered to a mast angle of approximately 177° (see the schematic of FIG. 14) by extending the mast raise cylinder 88. At this angle, the end of the mast 34 is low enough to the ground to allow the rigging of a load hoist line 50 through the sheave assembly 42 on the end of the mast 34. Once a load hoist line 50 has been rigged, the mast 34 is then raised back up to a mast angle of 160° (i.e., more than 20° above horizontal) (see FIG. 10) by contracting the mast raise cylinder 88. Once the mast 34 has been raised above a mast angle of 160°, then the boom hoist rigging 38 alone can be used to control the angle of the mast 34.

With the load hoist line 50 rigged to the mast 34, the mast 34 can be used to lift and position additional crane components to the crane 10. For example, the crawlers 24, if not previously assembled to the crane 10, can be lifted, positioned and assembled to the crane. Likewise, the counterweights 22 can be assembled to the crane 10 at this time. As shown sequentially in FIGS. 15 and 16, the mast 34 can also be used to assemble the boom butt 30, the boom inserts 32 and the boom top 28 to the upper works 12 of the crane 10.

While using the mast 34 to assemble additional crane components, the mast raise cylinder 88 is preferably fully extended so as to place the mast raising yoke 66 at an angle of 115°. When oriented at this angle, the mast raising yoke 66 serves as a backstop for the mast 34 to prevent the mast 34 from accidentally rotating back past vertical and collapsing onto the back of the upper works 12. This is particularly important when assembling components close to the crane 10, such as the crawlers 24, because the mast 34 must be positioned very close to vertical (i.e., a mast angle of 90°). As previously explained, the mast 34 can be very unstable when in a nearly vertical position. In addition, when the mast 34 is between 115° and 90°, the mast 34 must be controlled by using the mast raising yoke 66 in conjunction with the boom hoist rigging 38.

Once the boom 26 and other crane components have been assembled to the crane 10, the mast 34 is lowered down towards the front of the crane 10 and on top of the boom 26 for final rigging. Using the same procedure as described above, the mast raise cylinder 88 and the mast raising yoke 66 are used to lower the mast 34 when the mast angle is greater than 160° (i.e., less than 20° above horizontal). With the mast 34 resting on top of the boom 26, the load hoist line 50 can be reeved about the sheaves 54 at the end of the boom top 28, and the boom pendants 36 can be likewise connected thereto.

Once finally rigging of the boom 26 is complete, then the mast raise cylinder 88 and the mast raising yoke 66 are used to raise the mast 34 above a mast angle of 160° (i.e., more than 20° above horizontal). Above this mast angle, the mast 34 is raised and controlled by the boom hoist rigging 38 so as to raise the boom 26 off of the ground and place the crane 10 into operational mode (as shown in FIG. 1). At this time, the mast raise cylinder 88 is contracted so as to return the mast raising yoke 66 to the stored position. This prevents mast raising yoke 66 from interfering with the movement of the mast 34 during normal crane operations.

Self-disassembly of the crane 10 is accomplished by following the method described above in reverse order.

Although the mast 34 was described above as having an operational range of between 90° and 180° (between 115° and 160° when using the boom hoist rigging 38 alone), it should be noted that this range was only applicable when using the mast 34 during crane self-assembly and self-disassembly (e.g., when using the mast 34 to lift and assemble crane components to the crane 10). As can be seen in FIG. 1, the mast 34 has a different range of motion when connected to the boom 26. This is because the boom 26 applies a significant force to the end of the mast 34 that is opposite to the force that is applied to the mast 34 by the boom hoist rigging 38. Thus, the mast 34 is stable as long as the boom 26 is within the normal boom operating range.

Likewise, it should be apparent that the various angles discussed above are dependent on the geometry of the crane 10 and the components thereof. Thus, cranes having different geometries or different components may require a mast raising cylinder having a different configuration, or a mast cylinder with a different stroke length. Such changes or modifications should be within the skill of those skilled in the art of cranes and related machinery.

Although the above-described method and the specific operations therein can be manually controlled and coordinated by the crane operator, some of these operations are preferably performed or assisted by a microprocessor-based controller (i.e., computer) (not shown) on the crane 10. In particular, it can be very difficult to control both the mast raise cylinder 88 and the boom hoist rigging 38 during the mast self-raising procedure. For example, and as described above, when raising the mast 34 from the stored position, the operator must manipulate a first control to extend the mast raise cylinder 88 and rotate the mast raising yoke 66. The operator must simultaneously manipulate a second control to extend the boom hoist rigging 38. If the boom hoist rigging 38 is extended too quickly relative to the rotation of the mast raising yoke 66 (and the motion of the mast 34), then too much slack may be created in the boom hoist rope 40, which may then tangle with other crane components or become fouled in the sheave assemblies 42, 44, or which may allow the boom hoist rope 40 to unspool from the boom hoist drum 46. On the other hand, if the boom hoist rigging 38 is extended to slowly relative to the rotation of the mast raising yoke 66, then the mast 34 may collapse in response to loads applied thereto by the boom hoist rigging 38 and the mast raising yoke 66. Moreover, and as explained above, precise control of the boom hoist rigging 38 and the mast cylinder is particularly important when the mast 34 is near vertical or in the fully forward position (and very unstable).

In addition to the above, the operator may forget to perform certain steps in the mast self-raising procedure. For example, the operator may forget to place the mast raising yoke 66 into the stored position before lowering the mast 34 past the lower end of the operating range (i.e., below a mast angle of 160°). If so, then the mast 34 may become unstable and fall to the ground as it nears horizontal. The operator may also forget to place the mast raising yoke 66 into the mast backstop position (i.e., 115°) while using the mast 34 for crane assembly. Thus, it is preferable that at least some of the operations performed during the mast self-raising procedure be performed or assisted by a microprocessor-based controller or computer.

Figure 18:
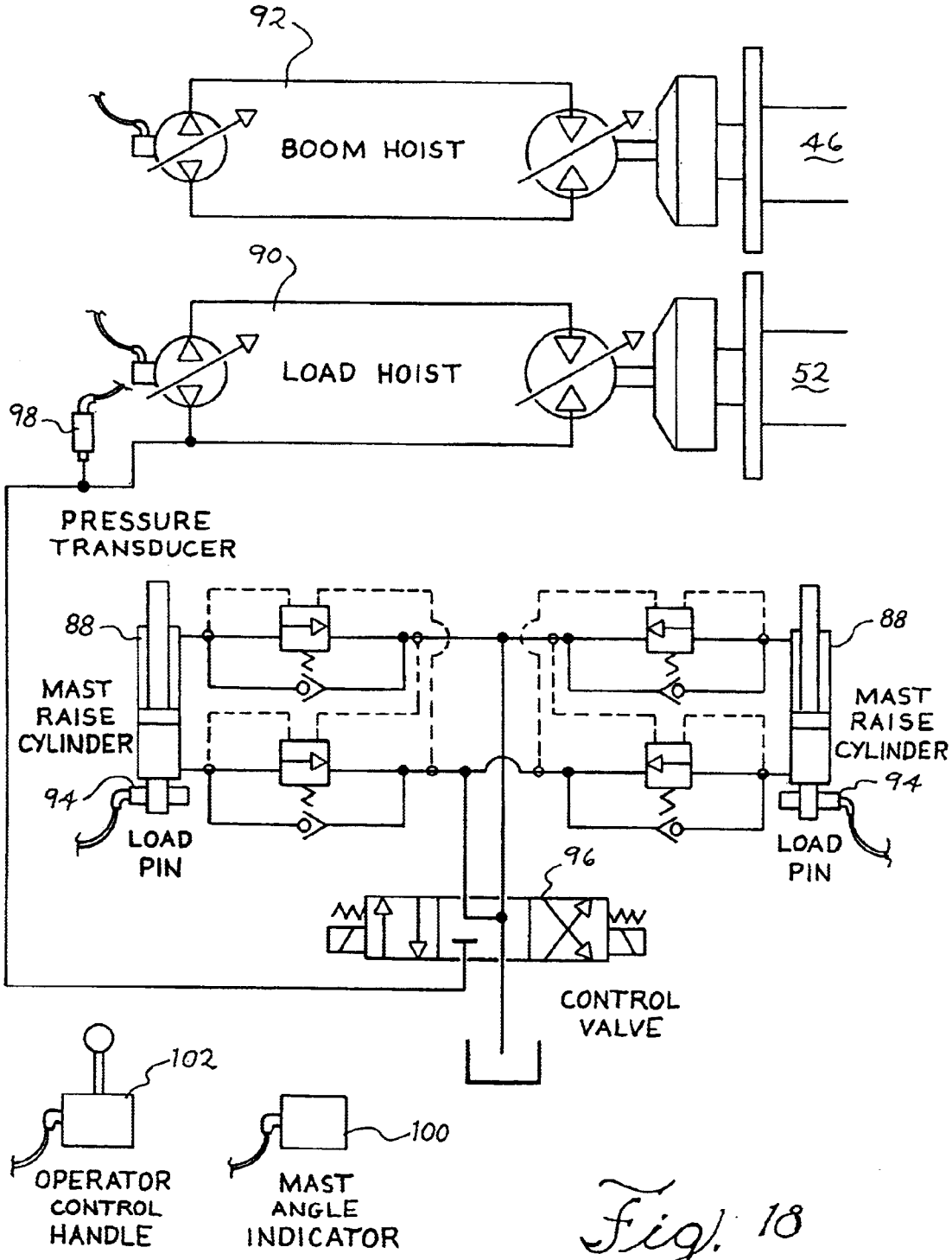
FIG. 18 is a schematic of the hydraulic circuit that controls the self-raising mast assemblies.

As shown schematically in FIG. 18, the mast raise cylinders 88 of the self-raising mast assemblies 64 utilize a closed loop hydraulic system. This closed loop system is, however, hydraulically connected to the load hoist pump 90 (i.e., the hydraulic pump used to rotate the load hoist drum), which supplies hydraulic pressure thereto. The microprocessor-based controller is connected to the load hoist pump 90, the boom hoist pump 92, load pins 94 attached to each of the mast raise cylinders 88, the control valve 96 and the pressure transducer 98. The controller can receive electrical signals from each of the load pins 94, the pressure transducer 98, the mast angle indicator 100 and the operator's control handle 102. The electrical signals from the load pins 94 are proportional to the mast loading on each mast raise cylinder 88. The electrical signal from the pressure transducer 98 is proportional to the hydraulic pressure generated by the load hoist pump 90. The electrical signals from the mast angle indicator 100 and the control handle 102 are proportional to mast angle and handle position, respectively. The controller can source electrical signals that control the flow output of the load hoist pump 90 and the position of the control valve 102.Software that is resident in the controller runs a routine that semi-automates the mast raising and lowering operation via the boom hoist pump 92, the load hoist pump 90 and the control valve 96. The mast raising and lowering is commanded from the operator's control handle 102. During the raising or lowering sequence the boom hoist rope 40 and the mast raise cylinders 88 must simultaneously (or alternately) restrain the mast 34 from falling and/or lift it into position.

In the preferred method of self-raising the mast 34, the crane operator uses the computer to place the crane 10 into set-up mode the crane operator then initiates the mast self-raising procedure by depressing the operator control handle 102. In response thereto, the computer will then begin to simultaneously pay out the boom hoist rope 40 and extend the mast raise cylinders 88 so as to raise the mast 34.

In the preferred method, the computer maintains a slight tension in the boom hoist rigging 38, which helps to maintain control of the mast 34 during the self-raising procedure. Utilizing the electrical signals from the two load pins 94, the mast angle indicator 100 and the pressure transducer 98, flow from the load hoist pump 90 and the boom hoist pump 92 are controlled during the raise/lower operations to maintain the proper restraining and lifting load combinations between the boom hoist rope 40 and the mast raise cylinders 88.

Electrical signals from the mast angle indicator 100 and the operator's control handle 102 are used to position the mast raise cylinders 88, and in turn the mast raising yoke 66, in the proper orientation so as to receive the mast 34 as it is lowered towards the full-forward position (i.e., beyond a mast angle of 160°), or as it is raised back towards vertical. In other words, if the crane 10 is in "set-up" mode, then the computer will monitor the angle of the mast 34 and coordinate the boom hoist rigging 38 and the self-raising mast assemblies 64 so as to safely maintain control of the mast 34 at all times during the mast self-raising procedure.

Additional sensors, such as pressure and speed sensors, may also be used to monitor the boom hoist rope tension and speed to provide additional monitoring mechanisms to ensure safe mast 34 self-raising and operating procedures.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

What is claimed is:

1. A crane having an upper works rotatably mounted on a lower works and a boom pivotally mounted on the upper works, said boom being supported by boom hoist rigging and a mast pivotally connected to the upper works, said crane further having a self-raising mast assembly for controlling the position of the mast when said mast is not connected to the boom, said self-raising mast assembly comprising:

a) a mast raising yoke pivotally connected to the upper works and having an axis of rotation that is coincident with the pivotal connection of the mast to the upper works, said mast raising yoke being configured to engage and support said mast when said mast is not supportable by said boom hoist rigging, and disengaged from said mast when said mast is supportable by said boom hoist rigging;

b) a hydraulic mast raise cylinder pivotally connected between the upper works and said mast raising yoke, said hydraulic mast raise cylinder being extendable and retractable so as to rotate said mast raising yoke about said axis of rotation; and c) a hydraulic system for controlling the extension and retraction of said hydraulic mast raise cylinder.

2. The crane according to claim 1 wherein said mast raising yoke comprises a rearward arm and a forward arm, said rearward arm being configured to engage and support said mast when said mast is between an approximately horizontal stored position towards a rearward portion of the upper works and an approximately vertical position, said forward arm being configured to engage and support said mast when said mast is near a horizontal position towards a forward portion of the crane.

3. The crane according to claim 2 wherein said rearward arm and said forward arm each comprise an engagement member configured to engage a lifting member on the mast, the engagement member on the rearward arm being engaged by said lifting member when said mast is between the stored position and the approximately vertical position, the engagement member on the forward arm being engaged by the lifting member when said mast is near the horizontal position towards the forward portion of the crane.

4. The crane according to claim 2 wherein said self-raising mast assembly comprises a pair of self-raising mast assemblies, each self-raising mast assembly being positioned to engage a leg of said mast.

5. The crane according to claim 2 wherein said mast is pivotal through an angle of approximately 180°.

6. The crane according to claim 2 wherein said mast raising yoke further comprises a lever arm pivotally connected to said mast raise cylinder.

7. The crane according to claim 1 further comprising a microprocessor-based controller for coordinating the extension and contraction of the hydraulic mast raise cylinder with extension and contraction of the boom hoist rigging.

8. The crane according to claim 7 wherein the microprocessor-based controller maintains a proper balance of forces in the boom hoist rigging and on the mast.

9. A crane having an upper works rotatably mounted on a lower works and a boom pivotally mounted on the upper works, said boom being supported by boom hoist rigging and a moving mast pivotally connected to the upper works, said boom hoist rigging being connected between a rearward portion of said upper works and an upper end of said mast, and boom pendants being connected between the upper end of said mast and said boom, wherein said crane further comprises self-raising mast assembly for raising and lowering the mast when said mast is not connected to the boom and is not supportable by the boom hoist rigging, said self-raising mast assembly comprising:

a) a mast raising yoke pivotally connected to the upper works and having an axis of rotation that is coincident with the pivotal connection of the mast to the upper works, said mast raising yoke having a rearward arm configured to engage and support said mast when said mast is between an approximately horizontal stored position towards the rearward portion of the upper works and an approximately vertical position, said rearward arm being disengaged from said mast when said mast is supported by said boom hoist rigging;

b) a hydraulic mast raise cylinder pivotally connected between the upper works and said mast raising yoke, said hydraulic mast raise cylinder being extendable and retractable so as to rotate said mast raising yoke about said axis of rotation; and c) a hydraulic system for controlling the extension and retraction of said hydraulic mast raise cylinder.

10. The crane according to claim 9 wherein said mast raising yoke further comprises a forward arm, said forward arm being configured to engage and support said mast when said mast is near a horizontal position towards a forward portion of the crane, said forward arm being disengaged from said mast when said mast is supported by said boom hoist rigging.

11. The crane according to claim 10 wherein said rearward arm and said forward arm each comprise an engagement slot configured to engage a lifting pin on the mast, the engagement slot on the rearward arm being engaged by said lifting pin when said mast is between the stored position and the approximately vertical position, the engagement slot on the forward arm being engaged by the lifting pin when said mast is near the horizontal position towards a forward portion of the crane.

12. The crane according to claim 11 wherein said self-raising mast assembly comprises a pair of self-raising mast assemblies, each self-raising mast assembly being positioned to engage a leg of said mast.

13. The crane according to claim 11 wherein said mast raising yoke further comprises a lever arm pivotally connected to said mast raise cylinder.

14. The crane according to claim 11 wherein said mast raising yoke is pivotal between a stored position and a mast backstop position, said rearward arm being generally horizontal when the mast raising yoke is in the stored position and generally vertical when the mast raising yoke is in the backstop position, said mast raising yoke being pivotal between the stored position and the mast backstop position by extension and contraction of the hydraulic mast raise cylinder.

15. The crane according to claim 14 wherein, when said mast raising yoke is in the mast backstop position, the rearward arm prevents said mast from falling onto the rearward portion of the upper works.

16. The crane according to claim 14 wherein, when said mast raising mast raising yoke is in the stored position, the forward arm prevents said mast from falling when said mast is near the horizontal position towards the forward portion of the crane.

17. The crane according to claim 11 wherein said mast is pivotal through an angle of approximately 180° when not connected to the boom.

18. The crane according to claim 17 wherein the mast, when not connected to the boom, is supportable by the rearward arm of the mast raising yoke when the angle of the mast is between approximately 0° and 115° as measured from the stored position, is supportable by the boom hoist rigging when the angle of the mast is between approximately 115° and 160°, and is supportable by the forward arm of the mast raising yoke when the angle of the mast is between approximately 160° and 180°.

19. The crane according to claim 11 wherein the engagement slot on said rearward arm and the engagement slot on said forward arm are separated by an angle of approximately 160°, said angle being measured about the axis of rotation of said mast raising yoke.

20. The crane according to claim 9 further comprising a microprocessor-based controller for coordinating the extension and contraction of the hydraulic mast raise cylinder with extension and contraction of the boom hoist rigging.

21. The crane according to claim 20 wherein the microprocessor-based controller maintains a proper balance of forces in the boom hoist rigging and on said mast when said mast is not connected to the boom.

22. A crane having an upper works rotatably mounted on a lower works and a boom pivotally mounted on the upper works, said boom being supported by boom hoist rigging and a moving mast pivotally connected to the upper works, said boom hoist rigging being connected between a rearward portion of said upper works and an upper end of said mast, and boom pendants being connected between the upper end of said mast and said boom, wherein said crane further comprises self-raising mast assembly for raising and lowering the mast when said mast is not connected to the boom and is not supportable by the boom hoist rigging, said self-raising mast assembly comprising:

a) a mast raising yoke pivotally connected to the upper works and having an axis of rotation that is coincident with the pivotal connection of the mast to the upper works, said mast raising yoke having a rearward arm and a forward arm, said rearward arm being configured to engage and support said mast when said mast is between an approximately horizontal stored position toward the rearward portion of the upper works and an approximately vertical position, said forward arm being configured to engage and support said mast when said mast is near a horizontal position towards a forward portion of the crane, said rearward arm and said forward arm being disengageable from said mast when said mast is supported by said boom hoist rigging;

b) a hydraulic mast raise cylinder pivotally connected between the upper works and said mast raising yoke, said hydraulic mast raise cylinder being extendable and retractable so as to rotate said mast raising yoke, the mast being raised or lowered by the rotation of said mast raising yoke when said mast is engaged by said rearward arm or said forward arm;

c) a hydraulic system for controlling the extension and retraction of said hydraulic mast raise cylinder; and d) a microprocessor-based controller for controlling said hydraulic system, the control of said hydraulic system being coordinated with extension or contraction of the boom hoist rigging.

23. The crane according to claim 22 wherein said rearward arm and said forward arm each comprise an engagement slot configured to engage a lifting pin on the mast, the engagement slot on the rearward arm being engaged by said lifting pin when said mast is between the stored position and the approximately vertical position, the engagement slot on the forward arm being engaged by the lifting pin when said mast is near the horizontal position towards the forward portion of the crane.

24. The crane according to claim 22 wherein said mast raising yoke further comprises a lever arm pivotally connected to said mast raise cylinder.

25. The crane according to claim 22 wherein said mast raising yoke is pivotal between a stored position and a mast backstop position, said rearward arm being generally horizontal when the mast raising yoke is in the stored position and generally vertical when the mast raising yoke is in the backstop position, said mast raising yoke being pivotal between the stored position and the mast backstop position by extension and contraction of the hydraulic mast raise cylinder.

26. The crane according to claim 25 wherein, when said mast raising yoke is in the mast backstop position, the rearward arm prevents said mast from falling on to the rearward portion of the upper works, and further wherein, when said mast raising mast raising yoke is in the stored position, the forward arm prevents said mast from falling when said mast is near the horizontal position towards the forward portion of the crane.

27. The crane according to claim 22 wherein the microprocessor-based controller is connected to a load-pin on said mast raise cylinder, said load pin providing an electrical signal to said microprocessor-based controller that is proportional to a load applied to the mast raise cylinder by said mast when said mast is engaged by said rearward arm or said forward arm.

28. The crane according to claim 22 wherein the hydraulic system comprises a closed loop hydraulic system, said closed loop hydraulic system being hydraulically connected to a load hoist pump through a control valve, said control valve regulating a hydraulic pressure in the closed loop hydraulic system in response to electrical signals received from the microprocessor-based controller.

29. A method of self-raising a mast for a crane having an upper works rotatably mounted on a lower works and a boom pivotally mounted on the upper works, said boom being supported by boom hoist rigging and a mast pivotally connected to the upper works, said crane further having a self-raising mast assembly for controlling the position of the mast when said mast is not connected to the boom and is not supportable by the boom hoist rigging, said self-raising mast assembly comprising a mast raising yoke pivotally connected to the upper works and having an axis of rotation, a hydraulic mast raise cylinder pivotally connected between the upper works and the mast raising yoke, and a hydraulic system for controlling the mast raise cylinder, said method comprising the sequential steps of:

a) engaging the mast with the mast raising yoke when the mast is in a rearwardly extending stored position on a rearward portion of the upper works;

b) extending the mast raise cylinder to rotate the mast raising yoke in a first direction so as to pivot the mast upwardly from the stored position to a forwardly leaning position;

c) supporting the mast with the boom hoist rigging when the mast is in the forwardly leaning position;

d) retracting the mast raise cylinder to rotate the mast raising yoke in a second direction so as to disengage said mast raising yoke from said mast when the mast is supported by the boom hoist rigging;

e) extending the boom hoist rigging to lower the mast towards a forwardly extending fully forward position;

f) engaging the mast with the mast raising yoke when the mast is near the fully forward position;

g) extending the mast raise cylinder to rotate the mast raising yoke in the first direction so as to pivot the mast downwardly to the fully forward position; and h) connecting the mast to the boom.

30. The method according to claim 29 wherein, when the mast is not connected to the boom, the mast is used to lift and assemble crane components to the crane.

31. A method of self-raising a mast for a crane having an upper works rotatably mounted on a lower works and a boom pivotally mounted on the upper works, said boom being supported by boom hoist rigging and a mast pivotally connected to the upper works, said crane further having a self-raising mast assembly for controlling the position of the mast when said mast is not connected to the boom and is not supportable by the boom hoist rigging, said self-raising mast assembly comprising a mast raising yoke having a rear ward arm and a forward arm pivotally connected to the upper works and having an axis of rotation that is aligned with an axis of rotation of said mast, a hydraulic mast raise cylinder pivotally connected between the upper works and the mast raising yoke, and a hydraulic system for controlling the mast raise cylinder, said method comprising the sequential steps of:

a) engaging the mast with the rearward arm of the mast raising yoke when the mast is in a rearwardly extending stored position on a rearward portion of the upper works, said rearward arm having an engagement slot that engages a lifting pin on the mast;

b) extending the mast raise cylinder to rotate the mast raising yoke in a first direction so as to pivot the mast upwardly from the stored position to a forwardly leaning position;

c) retracting the mast raise cylinder to rotate the mast raising yoke in a second direction so as to disengage the rearward arm of the mast raising yoke from said mast while the mast is in the forwardly leaning position;

d) supporting the mast with the boom hoist rigging while the mast is in the forwardly leaning position;

e) extending the boom hoist rigging to lower the mast towards a fully forward position;

f) engaging the mast with the forward arm of the mast raising yoke when the mast is near the fully forward position, said forward arm having an engagement slot that engages the lifting pin on the mast;

g) extending the mast raise cylinder to rotate the mast raising yoke in the first direction so as to pivot the mast downwardly to the fully forward position in front of the upper works;

h) connecting the mast to the boom;

i) retracting the mast raise cylinder to rotate the mast raising yoke in the second direction so as to pivot the mast upwardly from the fully forward position in front of the upper works; and j) retracting the boom hoist rigging to raise the mast and lift the boom into a crane operational range.

32. The method according to claim 31 wherein, when the mast is not connected to the boom, the mast is used to lift and assemble crane components to the crane.

33. A crane having an upper works rotatably mounted on a lower works and a boom pivotally mounted on the upper works, said boom being supported by boom hoist rigging and a mast pivotally connected to the upper works, said crane further having a self-raising mast assembly for controlling the position of the mast when said mast is not connected to the boom, said self-raising mast assembly comprising:

a) a mast raising yoke pivotally connected to the upper works and having an axis of rotation, said mast raising yoke being configured to engage and support said mast when said mast is not supportable by said boom hoist rigging, and disengaged from said mast when said mast is supportable by said boom hoist rigging;

b) a hydraulic mast raise cylinder pivotally connected between the upper works and said mast raising yoke, said hydraulic mast raise cylinder being extendable and retractable so as to rotate said mast raising yoke about said axis of rotation; and c) a hydraulic system for controlling the extension and retraction of said hydraulic mast raise cylinder, wherein said mast raising yoke comprises a rearward arm and a forward arm, said rearward arm being configured to engage and support said mast when said mast is between an approximately horizontal stored position towards a rearward portion of the upper works and an approximately vertical position, said forward arm being configured to engage and support said mast when said mast is near a horizontal position towards a forward portion of the crane.

34. The crane according to claim 33 wherein said rearward arm and said forward arm each comprise an engagement member configured to engage a lifting member on the mast, the engagement member on the rearward arm being engaged by said lifting member when said mast is between the stored position and the approximately vertical position, the engagement member on the forward arm being engaged by the lifting member when said mast is near the horizontal position towards the forward portion of the crane.

35. The crane according to claim 33 wherein said self-raising mast assembly comprises a pair of self-raising mast assemblies, each self-raising mast assembly being positioned to engage a leg of said mast.

36. The crane according to claim 33 wherein said mast is pivotal through an angle of approximately 180°.

37. The crane according to claim 33 wherein said mast raising yoke further comprises a lever arm pivotally connected to said mast raise cylinder.

38. The crane according to claim 33 further comprising a microprocessor-based controller for coordinating the extension and contraction of the hydraulic mast raise cylinder with extension and contraction of the boom hoist rigging.

39. The crane according to claim 38 wherein the microprocessor-based controller maintains a proper balance of forces in the boom hoist rigging and on the mast.

40. A crane having an upper works rotatably mounted on a lower works and a boom pivotally mounted on the upper works, said boom being supported by boom hoist rigging and a moving mast pivotally connected to the upper works, said boom hoist rigging being connected between a rearward portion of said upper works and an upper end of said mast, and boom pendants being connected between the upper end of said mast and said boom, wherein said crane further comprises self-raising mast assembly for raising and lowering the mast when said mast is not connected to the boom and is not supportable by the boom hoist rigging, said self-raising mast assembly comprising:

a) a mast raising yoke pivotally connected to the upper works and having an axis of rotation, said mast raising yoke having a rearward arm configured to engage and support said mast when said mast is between an approximately horizontal stored position towards the rearward portion of the upper works and an approximately vertical position, said rearward arm being disengaged from said mast when said mast is supported by said boom hoist rigging;

b) a hydraulic mast raise cylinder pivotally connected between the upper works and said mast raising yoke, said hydraulic mast raise cylinder being extendable and retractable so as to rotate said mast raising yoke about said axis of rotation; and c) a hydraulic system for controlling the extension and retraction of said hydraulic mast raise cylinder, wherein said mast raising yoke further comprises a forward arm, said forward arm being configured to engage and support said mast when said mast is near a horizontal position towards a forward portion of the crane, said forward arm being disengaged from said mast when said mast is supported by said boom hoist rigging.

41. The crane according to claim 40 wherein said rearward arm and said forward arm each comprise an engagement slot configured to engage a lifting pin on the mast, the engagement slot on the rearward arm being engaged by said lifting pin when said mast is between the stored position and the approximately vertical position, the engagement slot on the forward arm being engaged by the lifting pin when said mast is near the horizontal position towards a forward portion of the crane.

42. The crane according to claim 41 wherein said self-raising mast assembly comprises a pair of self-raising mast assemblies, each self-raising mast assembly being positioned to engage a leg of said mast.

43. The crane according to claim 41 wherein said mast raising yoke further comprises a lever arm pivotally connected to said mast raise cylinder.

44. The crane according to claim 41 wherein said mast raising yoke is pivotal between a stored position and a mast backstop position, said rearward arm being generally horizontal when the mast raising yoke is in the stored position and generally vertical when the mast raising yoke is in the backstop position, said mast raising yoke being pivotal between the stored position and the mast backstop position by extension and contraction of the hydraulic mast raise cylinder.

45. The crane according to claim 44 wherein, when said mast raising yoke is in the mast backstop position, the rearward arm prevents said mast from falling onto the rearward portion of the upper works.

46. The crane according to claim 44 wherein, when said mast raising mast raising yoke is in the stored position, the forward arm prevents said mast from falling when said mast is near the horizontal position towards the forward portion of the crane.

47. The crane according to claim 41 wherein said mast is pivotal through an angle of approximately 180° when not connected to the boom.

48. The crane according to claim 47 wherein the mast, when not connected to the boom, is supportable by the rearward arm of the mast raising yoke when the angle of the mast is between approximately 0° and 115° as measured from the stored position, is supportable by the boom hoist rigging when the angle of the mast is between approximately 115° and 160°, and is supportable by the forward arm of the mast raising yoke when the angle of the mast is between approximately 160° and 180°.

49. The crane according to claim 41 wherein the engagement slot on said rearward arm and the engagement slot on said forward arm are separated by an angle of approximately 160°, said angle being measured about the axis of rotation of said mast raising yoke.

50. The crane according to claim 40 further comprising a microprocessor-based controller for coordinating the extension and contraction of the hydraulic mast raise cylinder with extension and contraction of the boom hoist rigging.

51. The crane according to claim 40 wherein the microprocessor-based controller maintains a proper balance of forces in the boom hoist rigging and on said mast when said mast is not connected to the boom.

* * * * *

UNITED STATES PATENT AND TRADEMARK OFFICE

CERTIFICATE OF CORRECTION

PATENT NO. : 6,695,158 B2
DATED : February 24, 2004
INVENTOR(S) : John Taylor et al.

It is certified that error appears in the above-identified patent and that said Letters Patent is hereby corrected as shown below:

Column 14,
Line 13, delete “mast raising” (second occurrence).

Column 15,
Line 39, delete “mast raising” (second occurrence).

Column 16,
Line 35, delete “rear ward” and subtitute -- rearward -- in its place.

Column 18,
Line 64, delete “mast raising” (second occurrence).

Signed and Sealed this

First Day of February, 2005

JON W. DUDAS
*Director of the United States Patent and Trademark Office*